US006318719B1

(12) United States Patent
Yokoyama

(10) Patent No.: US 6,318,719 B1
(45) Date of Patent: Nov. 20, 2001

(54) TRANSPORTED-OBJECT STACKING APPARATUS

(75) Inventor: Atsuo Yokoyama, Gotemba (JP)

(73) Assignee: Tetra Laval Holdings & Finance, S.A. (CH)

( * ) Notice: Subject to any disclaimer, the term of this patent is extended or adjusted under 35 U.S.C. 154(b) by 0 days.

(21) Appl. No.: 09/310,758

(22) Filed: May 13, 1999

(30) Foreign Application Priority Data

May 22, 1998 (JP) ..... 10-141318

(51) Int. Cl.[7] ..... B65H 29/54
(52) U.S. Cl. ..... 271/309; 271/198; 271/276
(58) Field of Search ..... 271/309, 198, 271/276

(56) References Cited

U.S. PATENT DOCUMENTS 4,395,038 * 7/1983 Fitzpatrick et al. ..... 271/307 X

* cited by examiner

*Primary Examiner*—John Q. Nguyen
(74) *Attorney, Agent, or Firm*—Lorusso & Loud

(57) ABSTRACT

A transported-object stacking apparatus includes first fluid discharge unit and second fluid discharge unit. The first fluid discharge unit is disposed on one side of a transported object and is adapted to discharge working fluid in order to press the transported object against transporting unit. The second fluid discharge unit is disposed downstream from the first fluid discharge unit with respect to the direction of transport of the transported object and on the other side of the transported object, and is adapted to discharge working fluid toward a rear half portion of the transported object in order to separate the transported object from the transporting unit. When working fluid is discharged from the first fluid discharge unit, an object transported by the transporting unit is pressed against the transporting unit. Subsequently, when working fluid is discharged from the second fluid discharge unit toward a rear half portion of the transported object, the transported object is separated from the transporting unit.

3 Claims, 3 Drawing Sheets

TRANSPORTED-OBJECT STACKING APPARATUS

BACKGROUND OF THE INVENTION

1. Field of the Invention

The present invention relates to a transported-object stacking apparatus.

2. Description of the Related Art

Conventionally, in a transported-object stacking apparatus for stacking sheetlike transported objects one by one, a high-speed conveyor running at high speed and a low-speed conveyor running at low speed are arranged adjacent to each other, while a speed-reducing section is provided at the entrance of the low-speed conveyor. Objects transported on the high-speed conveyor are reduced in speed during transfer to the low-speed conveyor and are stacked on the low-speed conveyor.

However, in the conventional transported-object stacking apparatus, the front end of an object transported at high speed by the high-speed conveyor may collide with a rear portion of the preceding object transported at low speed by the low-speed conveyor, potentially resulting in jamming of transported objects.

Since the angle of a transported object entering the speed-reducing section, i.e., the angle of entry, is difficult to adjust, the preceding transported object may be hit hard by the front end of the following transported object. As a result, the surface of the preceding transported object may be damaged, rendering the object defective. Particularly, when a transported object is lightweight, the transported object enters the speed-reducing section at a relatively high speed. As a result, the posture of the transported object becomes very unstable during entry into the speed-reducing section.

To avoid such a postural instability, an object may be transported while being held between the high-speed conveyor and a guide belt running at a speed identical to that of the high-speed conveyor. However, this causes variations in, for example, positioning or timing curing transfer of a transported object from the high-speed conveyor to the low-speed conveyor.

To avoid such variations, the traveling speed of the high-speed conveyor may be decreased, or the span between transported objects may be increased. In such a case, however, the throughput of the transported-object stacking apparatus is impaired accordingly.

SUMMARY OF THE INVENTION

An object of the present invention is to solve the above-mentioned problems in the conventional transported-object stacking apparatus and to provide a transported-object stacking apparatus capable of preventing both jamming of transported objects and rendering an object defective without impairment of throughput.

To achieve the above object, a transported-object stacking apparatus according to the present invention comprises first fluid discharge means and second fluid discharge means. The first fluid discharge means is disposed on one side of a transported object and is adapted to discharge working fluid in order to press the transported object against transporting means. The second fluid discharge means is disposed downstream from the first fluid discharge means with respect, to the direction of transport of the transported object and on the other side of the transported object, and is adapted to discharge working fluid toward a rear half portion of the transported object in order to separate the transported object from the transporting means.

In this case, when working fluid is discharged from the first fluid discharge means, an object transported by the transporting means is pressed against the transporting means. Subsequently, when working fluid is discharged from the second fluid discharge means toward a rear half portion of the transported object, the transported object is separated from the transporting means.

Accordingly, the transported object can assume a very stable posture and thus can be constantly stacked in a magazine at a predetermined position.

Since the transported object to be stacked is inclined, two consecutive transported objects can be free from such a collision that the preceding transported object is hit hard by the front end of the following transported object, thereby preventing jamming of transported objects.

Another transported-object stacking apparatus according to the present invention comprises first transporting means, second transporting means, fluid discharge means, and fluid inversion means. The first transporting means is adapted to transport a transported object and travels on one side of the transported object. The second transporting means is adapted to transport the transported object and travels on the other side of the transported object. The fluid discharge means is disposed on one side of the transported object and is adapted to discharge working fluid. The fluid inversion means is disposed on the other side of the transported object, and has an entrance port for introducing thereinto working fluid discharged from the fluid discharge means and a discharge port for discharging therefrom working fluid introduced through the entrance port. The discharge port is located downstream of the entrance port with respect to the direction of transport of the transported object.

In this case, when working fluid is discharged from the fluid discharge means on one side of the transported object, the object transported by the first and second transporting means is pressed against the second transporting means. Subsequently, when the rear end of the transported object passes through a gap between the second transporting means and the fluid discharge means, working fluid discharged from the fluid discharge means enters the fluid inversion means through the entrance port and is discharged through the discharge port on the downstream side with respect to the direction of transport of the transported object to thereby press a rear end portion of the transported object downward.

Accordingly, the object is transported while being held between the first and second transporting means. Subsequently, the object is transported while being pressed against the second transporting means by means of working fluid. Then, the transported object is forcibly released from the second transporting means by means of working fluid discharged from the discharge port. Accordingly, the transported object can assume a very stable posture in a stacking region and thus can be constantly stacked in a magazine at a predetermined position.

Since the transported object to be stacked is inclined to thereby establish a wide gap between the second transporting means and the rear end of the transported object, two consecutive transported objects can be free from such a collision that the preceding transported object is hit hard by the front end of the following transported object, thereby preventing jamming of transported objects.

Still another transported-object stacking apparatus further comprises positioning means for positioning the fluid inversion means in the direction of transport of the transported object.

Since the fluid inversion means and the fluid discharge means can be positioned in the direction of transport of objects, the angle of entry of a transported object into the stacking region can be easily adjusted. Accordingly, two consecutive transported objects can be free from such a collision that the preceding transported object is hit hard by the front end of the following transported object. As a result, the surface of the preceding transported object cannot be damaged, so that rendering an object defective can be prevented. Particularly, when the surface of transported object bears printing, there can be reliably prevented an impairment in printed image quality which would otherwise result from damage to the printed surface.

Further, since transported objects can be stably stacked, there is no need for reducing the traveling speed of the first and second transporting means or increasing the interval between transported objects. Thus, the throughput of the transported-object stacking apparatus is not impaired.

BRIEF DESCRIPTION OF THE DRAWINGS

The structure and features of the transported-object stacking apparatus according to the present invention will be readily appreciated as the same because better understood by referring to the drawings, in which.

DESCRIPTION OF PREFERRED EMBODIMENT

Figure 1:
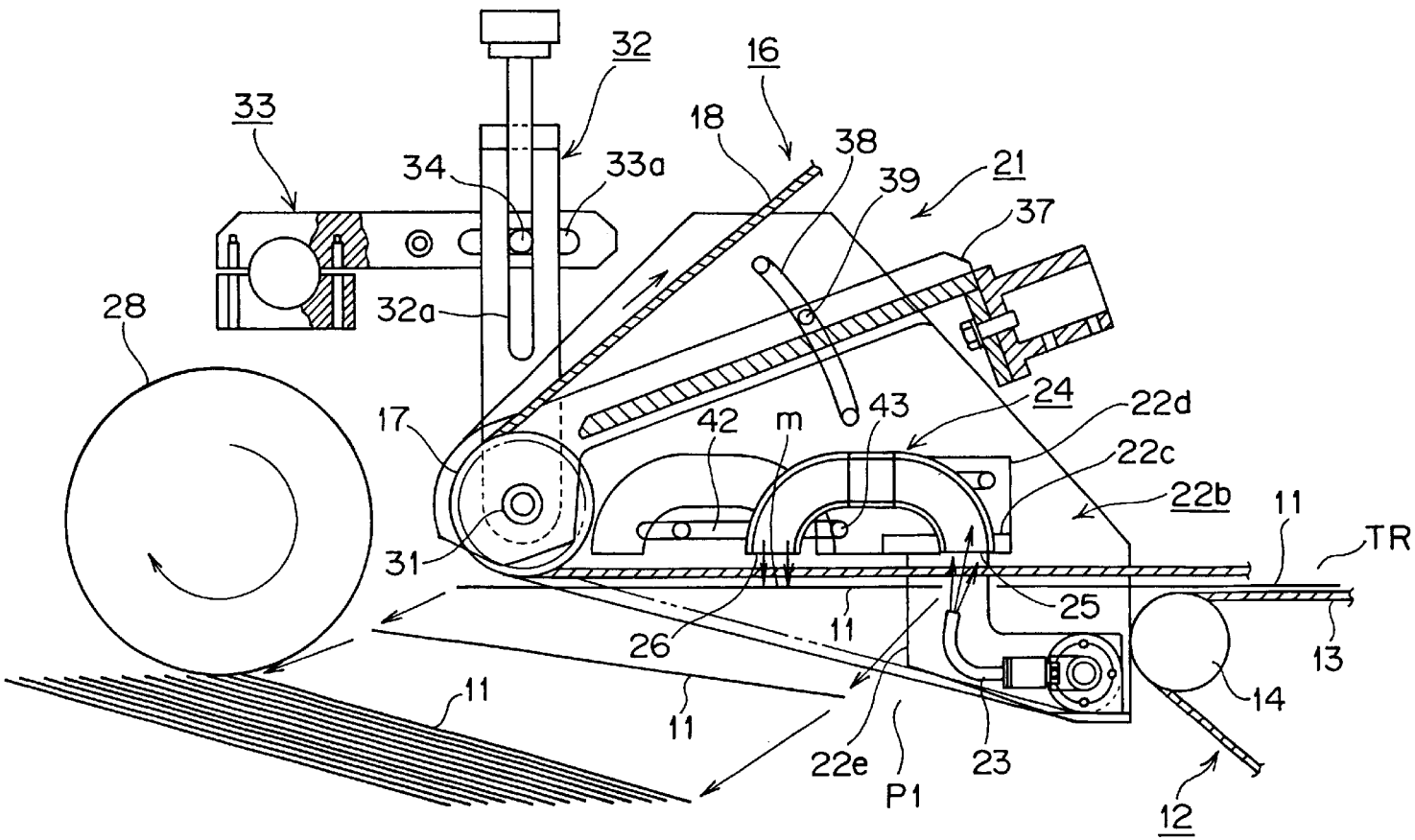
FIG. 1 is a sectional view of a transported-object stacking apparatus according to an embodiment of the present invention.
Figure 2:
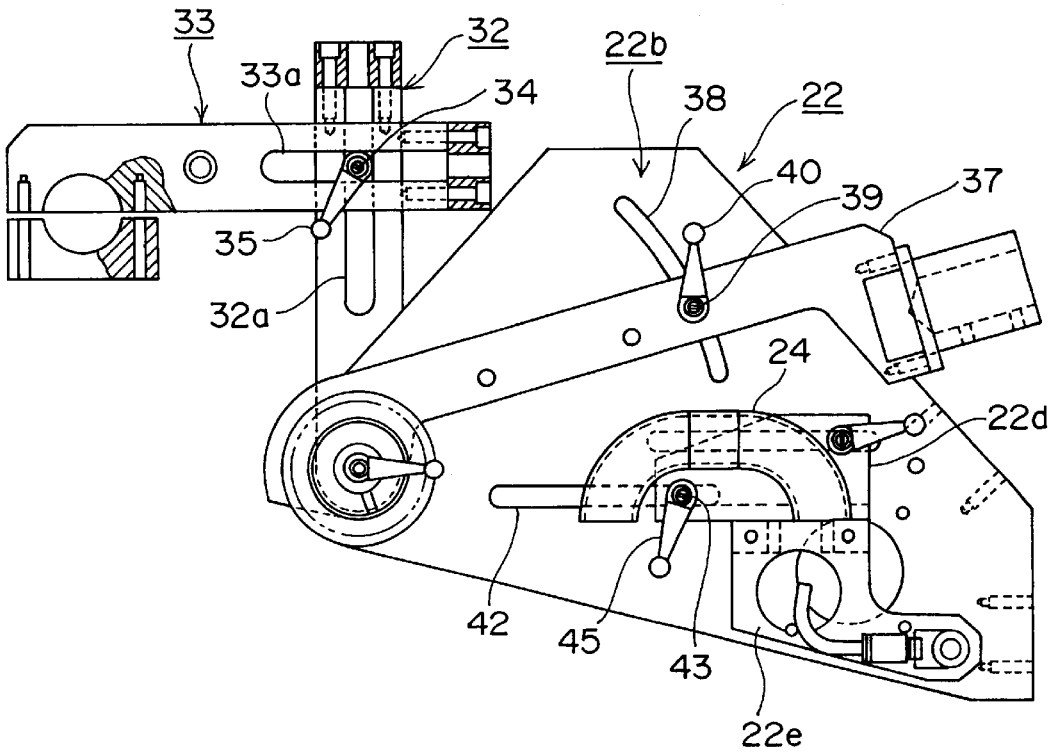
FIG. 2 is a side view of a main portion of the transported-object stacking apparatus according to the embodiment of the present invention.
Figure 3:
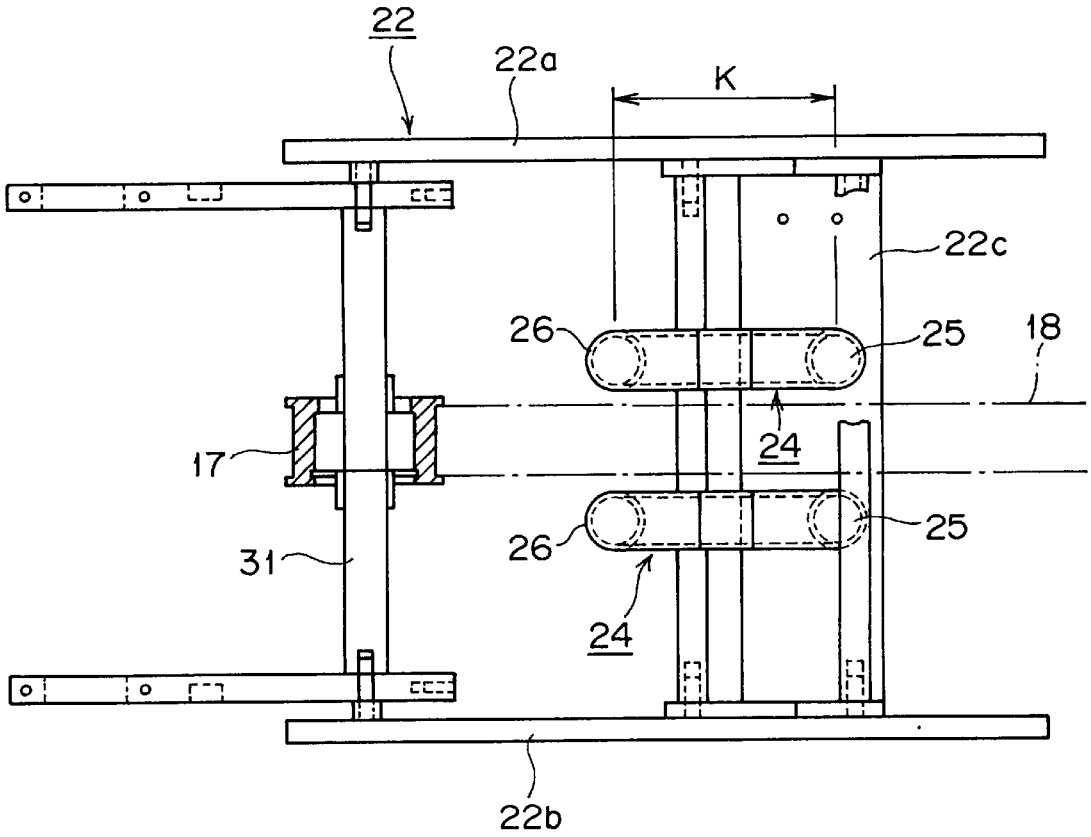
FIG. 3 is a plan view of the main portion of the transported-object stacking apparatus according to the embodiment of the present invention.

An embodiment of the present invention will next to described in detail with reference to the drawings.

In the drawings, reference numeral 11 denotes a sheetlike object, such as a blank, to be transported along a transport passage TR. Reference numeral 12 denotes a first conveyor which travels under the transport passage TR so as to transport the object 11 while facing one side of the transported object 11. The first conveyor 12 includes a plurality of transport rollers 14 and an endless belt 13 extending along the transport rollers 14. Reference numeral 16 denotes a second conveyor which travels above the transport passage TR so as to transport the object 11 while facing the other side of the transported object 11. The second conveyor 16 includes a plurality of transport rollers 17 and an endless belt 18 extending along the transport rollers 17. The first conveyor 12 serves as first transporting means, and the second conveyor 16 serves as second transporting means. Being disposed for supporting the transported object 11, the belt 13 has a width wider than that of the transported object 11. Being disposed for guiding the transported object 11, the belt 18 has a width narrower than that of the transported object 11.

According to the present embodiment, the first and second conveyors 12 and 16 travel at the same speed. However, the first and second conveyors 12 and 16 may travel at different speeds.

A stacking section P1 is located ahead (left-hand side in FIG. 1) of the first conveyor 12 and under the second conveyor 16 and is adapted to stack in an unillustrated magazine the objects 11 transported by the first and second conveyors 12 and 16. A stacking apparatus 21 is disposed in the stacking section P1. The stacking apparatus 21 includes a housing 22, a pair of nozzles 23, and a pair of inversion manifolds 24. The nozzles 23 are supported by the housing 22 and are adapted to discharge compressed air serving as working fluid and supplied from an unillustrated air source, thus serving as first fluid discharge means. The invention manifolds 24 are supported by the housing 22 and are adapted to invert compressed air introduced from the corresponding nozzles 23 so as to discharge compressed air against the transported object 11.

The housing 22 includes a pair of side walls 22*a* and 22*b*, a connection member 22*c*, and brackets 22*d* and 22*e*. The side walls 22*a* and 22*b* are disposed such that a predetermined space greater than the width of the transported object 11 is left therebetween. The connection member 22*c* is adapted to connect the side walls 22*a* and 22*b* together. The inversion manifolds 24 are attached to the connection member 22*c* via the bracket 22*d*. The nozzles 23 are attached to the connection member 22*c* via the bracket 22*e*. The inversion manifold 24 substantially assumes a shape of a inverse letter U and has an entrance port 25 and a discharge port 26 formed at opposite ends thereof. The entrance port 25 is directed downward so as to face the tip of the corresponding nozzle 23 in order to introduce compressed air discharged from the nozzle 23 into the inversion manifold 24. The discharge port 26 is directed downward so as to discharge compressed air introduced through the entrance port 25 toward a rear end portion of the transported object 11, thus serving as second fluid discharge means. The discharge port 26 is located downstream of the entrance port 25 with respect to the direction of transport of the object 11. Distance K between the entrance port 25 and the discharge port 26 along the direction of transport of the object 11 is determined according to the length of the transported object 11.

Thus, compressed air discharged from the nozzle 23 enters the inversion manifold 24 through the entrance port 25 and is inverted within the inversion manifold 24. Then, the compressed air is discharged through the discharge port 26 toward the transported object 11.

When the object 11 transported by the first and second conveyors 12 and 16 reaches the stacking section P1, compressed air discharged from the nozzles 23 causes the transported object 11, from the front end toward the rear end, to come into contact with the belt 18. Being pressed against the belt 18, the object 11 is transported by means of inertia thereof and the belt 18, during which the transported object 11 intercepts air flow between the nozzles 23 and the inversion manifolds 24.

Subsequently, when the rear end of the transported object 11 passes through the gaps between the nozzles 23 and the inversion manifolds 24, compressed air discharged from the nozzles 23 enters the invention manifolds 24 through the entrance ports 25. Thus-introduced compressed air is inverted within the inversion manifold 24 and is then discharged through the discharge ports 26 toward a rear half portion of the transported object 11, thereby pressing the transported object 11, for example, at point m (FIG. 1) located near the rear end (right end in FIG. 1) of the object 11. The distance between the point m and the rear end of the transported object 11 is determined on the basis of distance K mentioned above. However, the position of point m is set so as to be located between the center and the rear end of the transported object 11.

Accordingly, the transported object 11 is separated from the second conveyor 16 while assuming an inclined posture and is stacked in the aforementioned magazine. A guide roller 28 is disposed ahead of the stacking apparatus 21 in order to align front ends of the transported objects 11 being stacked. The guide roller 28 is rotated at a predetermined speed in the direction of the arrow of FIG. 1.

As described above, in the stacking section P1, the transported object 11 is inclined, so that a wide space is established between the belt 18 and the rear end of the transported object 11. Thus, the two consecutive transported objects 11 are free from such a collision that the front end of the following transported object 11 collides with the rear portion of the preceding transported object 11, thereby preventing jamming of the transported objects 11.

A shaft 31 is disposed in the vicinity of the front end of the housing 22 and rotatably supports the transport roller 17. The shaft 31 is supported by an unillustrated frame via a vertical support member 32 and a horizontal support member 33. An elongated hole 32*a* is formed in the vertical support member 32. An elongated hole 33*a* is formed in the horizontal support member 33 in such a manner as to cross the elongated hole 32*a*. A pin 34 is disposed in such a manner as to extend through the elongated holes 32*a* and 33*a*. By positioning the pin 34 as desired along the elongated holes 32*a* and 33*a* and fastening the pin 34 by means of the fastening handle 35, the housing 22 can be vertically and horizontally positioned. The elongated holes 32*a* and 33*a*, the pin 34, and the fastening handle 35 cooperatively serve as positioning means.

As inclined support member 37 extends obliquely upward from the shaft 31. An arc-shaped elongated hole 38 is formed in the side wall 22*b* at an upper predetermined position. The shaft 31 is the center of the arc into which the elongated hole 38 is shaped. A pin 39 is disposed at such a manner as to extend through the elongated hole 38. By positioning the pin 39 as desired along the elongated hole 38 and fastening the pin 39 by means of the fastening handle 40, the housing 22 can be inclined at a predetermined angle. The elongated hole 38, the pin 39, and the fastening handle 40 cooperatively serve as positioning means.

Further, an elongated hole 42 is formed in the side wall 22*b* at a lower predetermined position. A pin 43 is disposed in such a manner as to extend through the elongated hole 42. By positioning the pin 43 as desired along the elongated hole 42 and fastening the pin 43 by means of the fastening handle 45, the inversion manifolds 24 and the nozzles 23 can be horizontally positioned with respect to the housing 22. The elongated hole 42, the pin 43, and the fastening handle 45 cooperatively serve as positioning means.

As described above, the housing 22 can be vertically and horizontally positioned and can be inclined at a predetermined angle, and the invention manifolds 24 and the nozzles 23 can be horizontally positioned with respect to the housing 22. Thus, the angle of entry of the transported object 11 into the stacking section P1 can be easily adjusted. Therefore, the two consecutive transported objects 11 can be free from such a collision that the preceding transported object 11 is hit hard by the front end of the following transported object 11. As a result, the surface of the preceding transported object 11 cannot be damaged, so that rendering the object 11 defective can be prevented. Particularly, when the surface of the transported object 11 bears printing, there can be reliably prevented an impairment in printed image quality which would otherwise result from damage to the printed surface.

Further, since the transported objects 11 can be stably stacked in the aforementioned magazine, there is no need for reducing the traveling speed of the first and second conveyors 12 and 16 or increasing the interval between the transported objects 11. Thus, the throughput of the transported-object stacking apparatus is not impaired.

For example, when the transported object 11 is a sheet having a length of about 300 mm, a width of about 300 mm, a thickness of about 0.5 to 2 mm, and a weight of about 40 g, the transported object 11 enters the stacking section P1 at a relatively high speed of about 3 to 5 m/s. However, the transported object 11 can assume a very stable posture in the stacking section P1 and thus can be constantly stacked in the aforementioned magazine at a predetermined position, for the following reason. The object 11 is transported while being held between the first and second conveyors 12 and 16. Subsequently, the object 11 is transported while being pressed against the belt 18 by means of compressed air. Then, the transported object 11 is forcibly released from the belt 18 by means of compressed air discharged from the discharge port 26.

The present invention is not limited to the above-described embodiment. Numerous modifications and variations of the present invention are possible in light of the spirit of the present invention, and they are not excluded from the scope of the present invention.

What is claimed is:

1. A transported-object stacking apparatus comprising:

(a) discharge transporting means;

(b) first fluid discharge means disposed on one side of a transported object and adapted to discharge working fluid at a first position in order to press the transported object against said discharge transporting means; and (c) second fluid discharge means disposed downstream from said first fluid discharge means with respect to the direction of transport of the transported object and on the other side of the transported object, said second fluid discharge means being adapted to discharge working fluid at a second position downstream from the first position toward a rear half portion of the transported object in order to separate the transported object from the discharge transporting means and to establish a wide space between the discharge transporting means and the rear end of the transported object.

2. A transported-object stacking apparatus comprising:

(a) first transporting means adapted to transport a transported object and traveling on one side of the transported object;

(b) second transporting means adapted to transport the object and traveling on the other side of the transported object;

(c) fluid discharge means disposed on one side of the transported object and adapted to discharge working fluid to press the transported object against the second transporting means; and (d) fluid inversion means disposed on the other side of the transported object and having an entrance port for introducing thereinto working fluid discharged from said fluid discharge means and a discharge port for discharging therefrom working fluid introduced through said entrance port in order to separate the transported object from the second transporting means, said discharge port being located downstream of said entrance port with respect to the direction of transport to the transported object.

3. A transported-object stacking apparatus according to claim 2, further comprising positioning means for positioning said fluid inversion means in the direction of transport of the transported object.

* * * * *

UNITED STATES PATENT AND TRADEMARK OFFICE

CERTIFICATE OF CORRECTION

PATENT NO. : 6,318,719 B1
DATED : November 20, 2001
INVENTOR(S) : Yokoyama

It is certified that error appears in the above-identified patent and that said Letters Patent is hereby corrected as shown below:

Column 1,
Line 39, “curing” should read -- during --; and
Line 62, “respect,” should read -- respect --.

Column 4,
Line 5, “invention” should read -- inversion --.

Signed and Sealed this

Eighteenth Day of June, 2002

*Attest:*

*Attesting Officer*

JAMES E. ROGAN
*Director of the United States Patent and Trademark Office*